US007713383B2

(12) United States Patent
Saetherasen et al.

(10) Patent No.: US 7,713,383 B2
(45) Date of Patent: May 11, 2010

(54) ARRANGEMENT FOR FEEDING A SLURRY OF CHIPS AND LIQUID

(75) Inventors: Jonas Saetherasen, Hammaro (SE); Vidar Snekkenes, Karlstad (SE); Bo Wilke, Karlstad (SE); Lennart Gustavsson, Karlstad (SE)

(73) Assignee: Metso Fiber Karlstad AB, Karlstad (SE)

( * ) Notice: Subject to any disclaimer, the term of this patent is extended or adjusted under 35 U.S.C. 154(b) by 478 days.

(21) Appl. No.: 11/908,970

(22) PCT Filed: Mar. 21, 2006

(86) PCT No.: PCT/SE2006/050037

§ 371 (c)(1),
(2), (4) Date: Sep. 18, 2007

(87) PCT Pub. No.: WO2006/101449

PCT Pub. Date: Sep. 28, 2006

(65) Prior Publication Data

US 2008/0202717 A1 Aug. 28, 2008

(30) Foreign Application Priority Data

Mar. 23, 2005 (SE) ..... 0500672
Mar. 21, 2006 (WO) ..... PCT/SE2006/050037

(51) Int. Cl.
*D21C 7/00* (2006.01)

(52) U.S. Cl. ..... 162/237; 162/236; 162/246; 162/52; 162/56

(58) Field of Classification Search ..... 162/237, 162/236, 246, 52, 53
See application file for complete search history.

(56) References Cited

U.S. PATENT DOCUMENTS 5,736,005 A * 4/1998 Flodquist ..... 162/52
6,436,233 B1 8/2002 Barrett et al.

FOREIGN PATENT DOCUMENTS

SE 180289 5/1957

* cited by examiner

*Primary Examiner*—Mark Halpern
(74) *Attorney, Agent, or Firm*—Rolf Fasth; Fasth Law Offices

(57) ABSTRACT

The method and arrangement is for the feed of a chips suspension from one vessel to a subsequent digester in a continuous cooking process for the production of chemical cellulose pulp. The vessel has an inlet defined therein for the input of chips and an outlet defined therein for the output of a chips suspension. The chips suspension in the vessel has a first fluid/wood ratio established above a second fluid/wood ratio that is established at the bottom of the vessel. The second fluid/wood ratio is at least as great as, preferably greater than, the first fluid/wood ratio. After the output of the chips suspension from the vessel and before the chips suspension is placed under pressure for onwards transport to a subsequent digester, a fraction of fluid is withdrawn from the chips suspension, whereby a third fluid/wood ratio is established in the chips suspension.

14 Claims, 8 Drawing Sheets

ARRANGEMENT FOR FEEDING A SLURRY OF CHIPS AND LIQUID

PRIOR APPLICATION

This application is a U.S. national phase application based on International Application No. PCT/SE2006/050037, filed 21 Mar. 2006, claiming priority from Swedish Patent Application No. 0500672-1, filed 23 Mar. 2005.

TECHNICAL AREA

The present invention concerns a method and an arrangement for the feed of a chips suspension from one vessel to a subsequent digester in a continuous cooking process for the production of chemical cellulose pulp.

BACKGROUND AND SUMMARY OF THE INVENTION

The use of scraper devices at the bottom of digesters and impregnation vessels in the continuous cooking of chemical cellulose pulp has been long known. The aim of these scraper devices is to ensure a continuous output of the cellulose pulp or chips from the vessel. The scraper device consists of a number of scraper arms that are arranged on the shaft that is arranged to be vertical during production. The motion of the arms in the suspension of pulp or chips counteracts the formation of blockages, the formation of channels, and other undesired effects.

The above-mentioned shaft for the operation of the said scraper arms has been used since early times for the addition of fluid at the lower part of the digester or impregnation vessel. The addition of fluid occurs in this case by making the shaft hollow and leading fluid in through this way. The primary purpose of adding fluid has been to wash the pulp. This addition of fluid through the shaft has more recently been used for the dilution of the pulp with the aim of ensuring output from the vessel. U.S. Pat. No. 5,736,005 reveals a variant of such a hollow shaft in which fluid is added to a continuous digester with the aim of ensuring output from the digester.

An alternative to the above-described addition of fluid with the aim of diluting and ensuring output of the pulp or chips from the digester or the impregnation vessel is to add the fluid at the lower part of the vessel through a fluid supply device through the vessel. It is preferable that this addition takes place in the vicinity of the scraper device. SE 180 289 reveals an embodiment in which the fluid supply device adds fluid close to the bottom of a container with the aim of preventing the formation of blockages of cellulose fibres.

Addition of fluid by the methods that have been described above, however, involves a number of disadvantages, particularly when the addition is made to an impregnation vessel.

In the cases in which the fluid is added to an impregnation vessel, the extra addition of fluid must be dealt with by the top separator in subsequent digesters, which involves a considerable extra expense at the top separator.

Furthermore, the added fluid involves large volumes of fluid that the system must deal with, and this in turn involves expensive investment and high operating costs of pumps and high-pressure taps, or both.

The same problem arises, naturally, also in those cases in which no fluid has been added at the bottom of the impregnation vessel due to the fluid/wood ratio of the chips suspension being so high that it is not necessary to add fluid in order to ensure output from the impregnation vessel.

THE AIMS OF THE INVENTION

The principal aim of the present invention is to either eliminate or reduce the above-described problems and disadvantages in association with the output of cellulose pulp from an impregnation vessel to a transfer line, where the invention allows:

- a reduction in the amount of fluid in the chips suspension that is fed out from the impregnation vessel to the digester, i.e. a reduction in the fluid/wood ratio;
- the ability initially to establish a stable flow out from the bottom of the impregnation vessel with only instantaneously increased fluid volumes, or the opportunity for increased dilution in the bottom of the impregnation vessel without the increased amounts of fluid needing for this reason to be pumped onwards into the transfer line;
- the ability to use a smaller and cheaper top separator in subsequent digesters as a consequence of the lower volumes of fluid, and preferably the ability to eliminate completely a top separator;
- the ability to use smaller and cheaper pumps or high-pressure taps, or both, that consume lower power, due to the lower volumes of fluid.

BRIEF DESCRIPTION OF DRAWINGS

The invention will be described in more detail below with the aid of the attached drawings, of which.

DETAILED DESCRIPTION OF THE INVENTION

The concept "chips suspension" will be used in the following detailed description of the invention. This term is here used to denote chips together with fluid, which suspension is treated in an impregnation vessel and fed out from the said impregnation vessel to a subsequent digester in a continuous cooking process for the production of cellulose pulp.

A further expression that will be used is "fluid/wood ratio". This expression is here used to denote the relationship between fluid and wood that is prevalent in the chips suspension.

Furthermore, the expression "perforated strainer hole or slit" will be used in the description of strainer surfaces. This expression is here used to denote penetrating openings in the surface with no requirements placed on their shape. Thus, these openings may be round, square, triangular, etc. Furthermore, it is also possible to conceive that the perforations consist of penetrating slits that may be straight, bent, curved, etc.

Finally, the concept "feed device" will be used. This term is here used to denote a device that is intended to feed the chips suspension from an impregnation vessel to a digester by the application of pressure. Examples of such feed devices are pumps and high-pressure taps.

Figure 1:
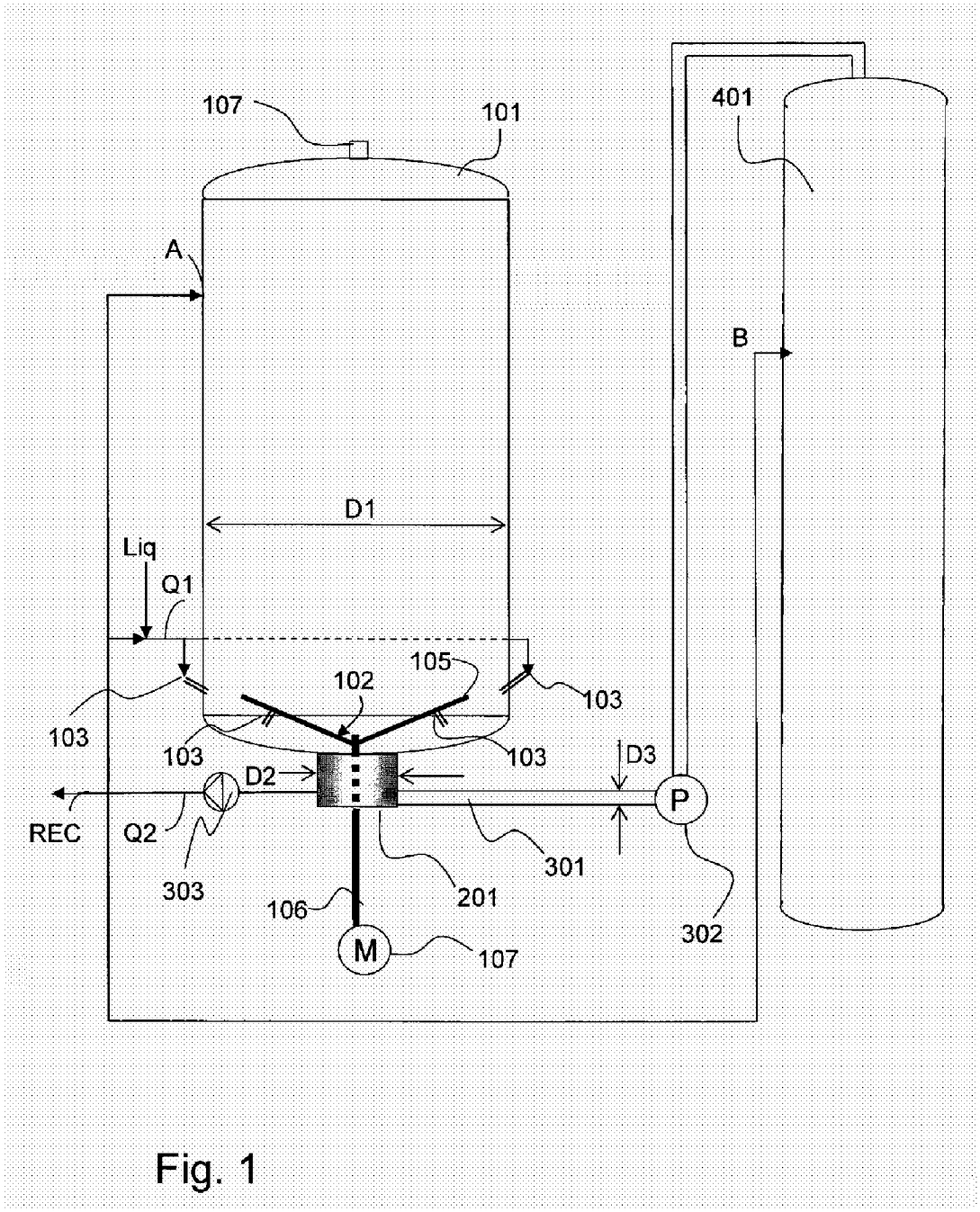
FIG. 1 shows one preferred embodiment of an impregnation vessel in which the arrangement according to the invention is included.

FIG. 1 shows the lower part of a principally cylindrical vertically arranged impregnation vessel 101 for the impregnation of chips, which impregnation vessel precedes a digester 401 in a continuous cooking process for the production of chemical cellulose pulp. The impregnation vessel has a diameter D1, an inlet 107 at the top of the vessel into which untreated chips are fed, and a bucket-shaped outlet 201 at the bottom of the vessel from which a chips suspension, i.e. impregnated chips with fluid, is fed out. The chips suspension in the impregnation vessel has a first fluid/wood ratio, which first fluid/wood ratio preferably lies within the interval 2-7.

In order to facilitate the output of the chips suspension from the impregnation vessel 101, a mechanical stirrer 102 is arranged at the bottom of the impregnation vessel 101, in order to obtain stirring of the chips suspension. The stirrer 102 comprises a number of scraper arms 105, preferably two, that are arranged at the upper end of a shaft 106 that is vertically arranged. The shaft 106 is driven at its lower end by means of a directly acting driver device 107. The stirring of the chips suspension breaks the orientation of the chips in association with the output process, such that the output from the impregnation vessel is facilitated.

In order to ensure further the output of the chips suspension from the impregnation vessel 101, dilution fluid is added in a known manner in an amount of Q1 in the vicinity of the bottom by means of at least one dilution fluid supply nozzle 103. The dilution fluid supply nozzles 103 are most often arranged through the wall of the impregnation vessel 101 or in the scraper arms 105. In the embodiment in which the dilution fluid supply nozzles 103 are arranged in the scraper arms 105, the fluid is led to the scraper arms 105 through a hole in the shaft 106 (not shown in the drawing) through which fluid flows. The total amount of dilution fluid that is added to the impregnation vessel 101 from the dilution fluid supply nozzles 103 will hereafter be referred to as Q1. The chips suspension after the addition of the dilution fluid has a second fluid/wood ratio, which is higher than the first fluid/wood ratio further up in the impregnation vessel, which second fluid/wood ratio is established in order to ensure an even output that is free of disturbances. This second fluid/wood ratio preferably lies in the interval 6-10. Operating conditions can, however, occur in which Q1=0, i.e. no dilution fluid is added through the dilution fluid supply nozzles 103, and in the cases in which the first and the second fluid/wood ratios are equal, this ratio lies in the interval 6-10.

In order to summarise briefly the relationship between the first and the second fluid/wood ratios, it can be stated that the chips suspension in the vessel 101 has the first fluid/wood ratio established above the second fluid/wood ratio, where the second fluid/wood ratio is established at the bottom of the vessel. The second fluid/wood ratio is at least as large as the first fluid/wood ratio, preferably larger.

The chips suspension, i.e. the impregnated chips together with the fluid, is continuously fed out from the impregnation vessel 101 through a bucket-shaped outlet 201 arranged in and under the bottom of the impregnation vessel 101 below the scraper device 102. The bucket-shaped outlet 201 has a diameter D2 that is less than the diameter of the impregnation vessel D1, i.e. D2<D1. The diameter D2 of the bucket-shaped outlet is approximately 1-1.5 m for an impregnation vessel 101 with a diameter D1 of 3-5 m. For an impregnation vessel with a diameter D1 of 10 m, D2 can have a dimension of approximately 2 m. The diameter D2 is thus less than 50% of D1 and preferably in the interval 15—40% of D1. Parts of the wall of the bucket-shaped outlet, or the complete wall, consist of perforated strainer holes or slits. The strainer holes or slits are surrounded by a withdrawal space 206 at the outer wall of the outlet from which withdrawal space 206 the partial fluid volume Q2 is withdrawn from the chips suspension by means of a pump 303, before the remainder of the chips suspension is sent in the outlet line 301 to subsequent digesters 401 through being placed under pressure by a pressure device 302. The outlet line 301 is connected to the wall section of the bucket-shaped outlet, which outlet line 301 has a diameter D3, where D1, D2 and D3 have the following relationship: D1>D2>D3. The chips suspension after the withdrawal of fluid has a third fluid/wood ratio, which is lower than the second fluid/wood ratio. This third fluid/wood ratio lies in the interval 5-9, and is at least 1 unit, preferably at least 2 units, lower than the second fluid/wood ratio, which lies in the interval 6-10.

The withdrawn fluid Q2 can then be sent to any one or to a combination of the following:

- Q2 is sent in a circulation line that is connected at its first inlet end to at least one withdrawal space (206) arranged at the bucket-shaped outlet (201) and where a second end of the circulation line is connected to a recovery process (REC). A natural position if it is desired to withdraw consumed impregnation fluid, which in turn has been partly constituted by a withdrawal from the digester.
- Q2 is sent in a circulation line that is connected at its first inlet end to at least one withdrawal space (206) arranged at the bucket-shaped outlet (201) and where a second end of the circulation line is connected to a dilution fluid supply nozzle (103). In this case it is solely a question of a local dilution.
- Q2 is sent in a circulation line that is connected at its first inlet end to at least one withdrawal space (206) and where the second end of the circulation line is connected to a position (A) close to the top of the impregnation vessel (101).
- Q2 is sent in a circulation line that is connected at its first inlet end to at least one withdrawal space (206) and where the second end of the circulation line is connected to a position (B) in a subsequent digester (401). This is done with the aim of, if it is desired at any cooking phase, to modify the digestion conditions, possibly to raise the sulphidity, or to initiate precipitation of early dissolved XYLAN onto the fibres in the digester.

Figure 2A:
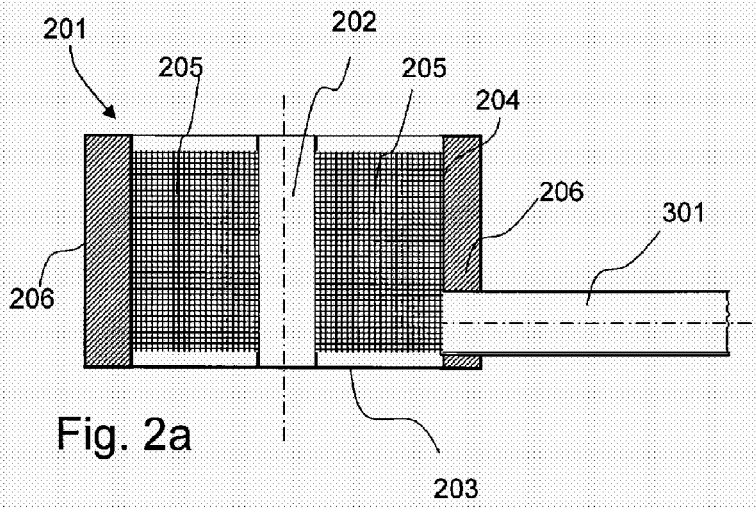
FIG. 2*a* shows a side view with a section A-A and FIG. 2*b* shows a top view of a first preferred embodiment of the bucket-shaped outlet 201.
Figure 2B:
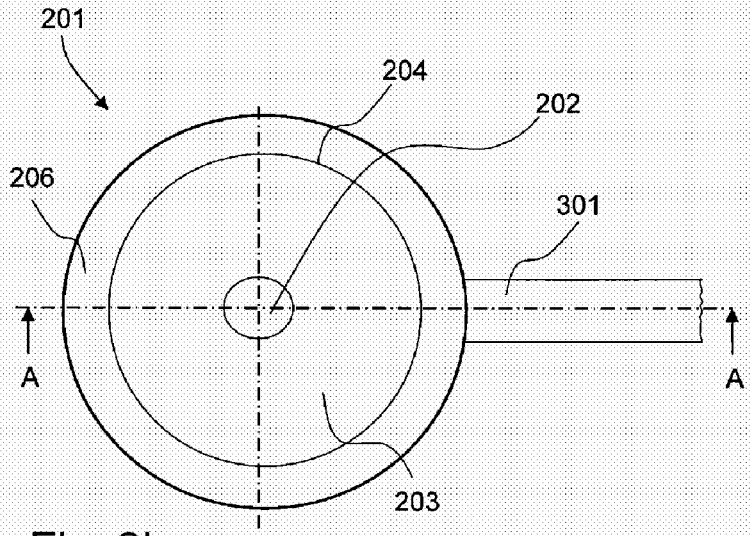

FIGS. 2*a* and 2*b* show a first preferred embodiment of the bucket-shaped outlet 201 where parts of, and preferably the complete, surface 204 of the outlet is perforated with strainer holes or slits 205, and from which perforated surface 204 a fraction Q2 of the fluid in the chips suspension is withdrawn with a pump 303 through a withdrawal space 206 arranged around the strainer holes or slits of the outer surface 204. The shaft 106 (not shown in this drawing) passes through a penetrating opening 202 in the bucket-shaped outlet 201.

Figure 3A:
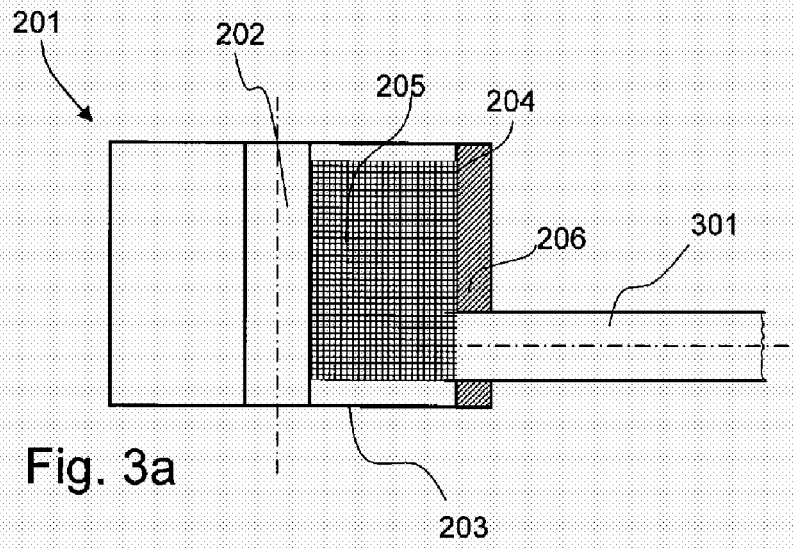
FIG. 3*a* shows a side view with a section B-B and FIG. 3*b* shows a top view of a second preferred embodiment of the bucket-shaped outlet 201.
Figure 3B:
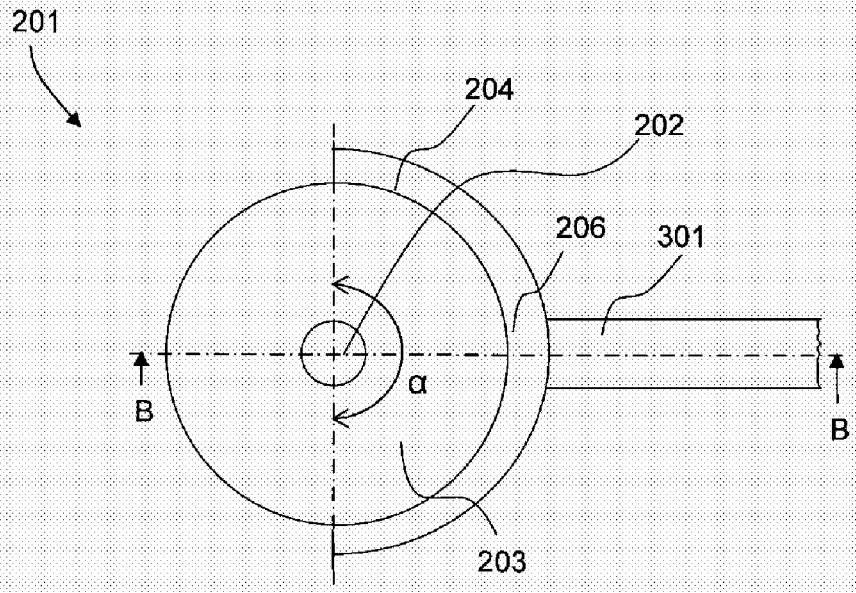

FIGS. 3*a* and 3*b* show a second preferred embodiment of the bucket-shaped outlet 201 where the surface 204 of the outlet 201 is perforated with strainer holes or slits 205 over a surrounding angle α between 90° and 270°, preferably 180°, and from which perforated surface 204 a fraction Q2 of the fluid in the chips suspension is withdrawn by a pump 303 through a withdrawal space 206 arranged around the strainer holes or slits of the outer surface 204. The shaft 106 (not shown in this drawing) passes through a penetrating opening 202 in the bucket-shaped outlet 201.

Figure 4A:
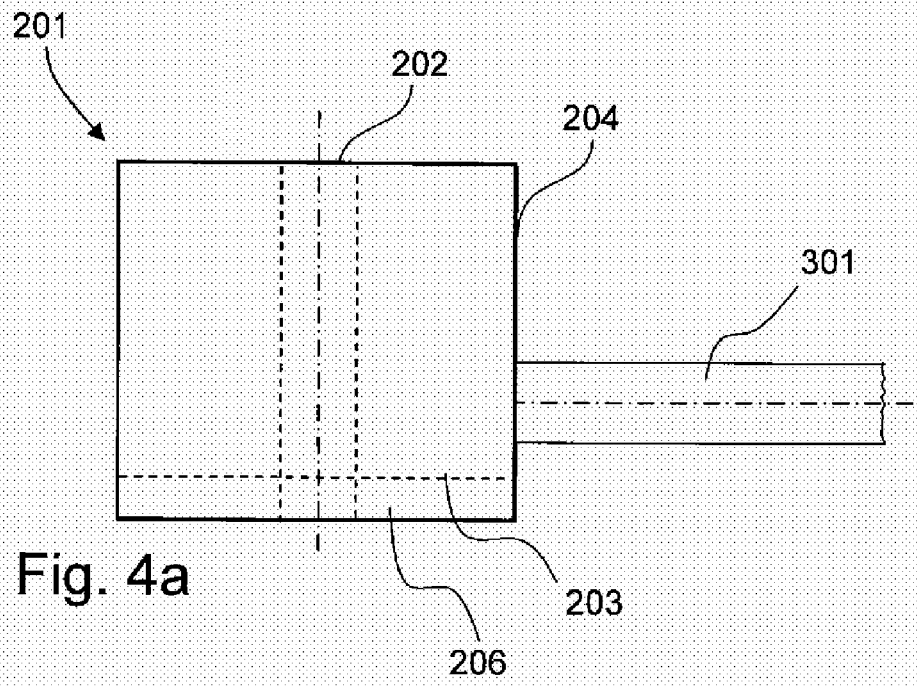
FIG. 4*a* shows a side view and FIG. 4*b* shows a top view of a third preferred embodiment of the bucket-shaped outlet 201.
Figure 4B:
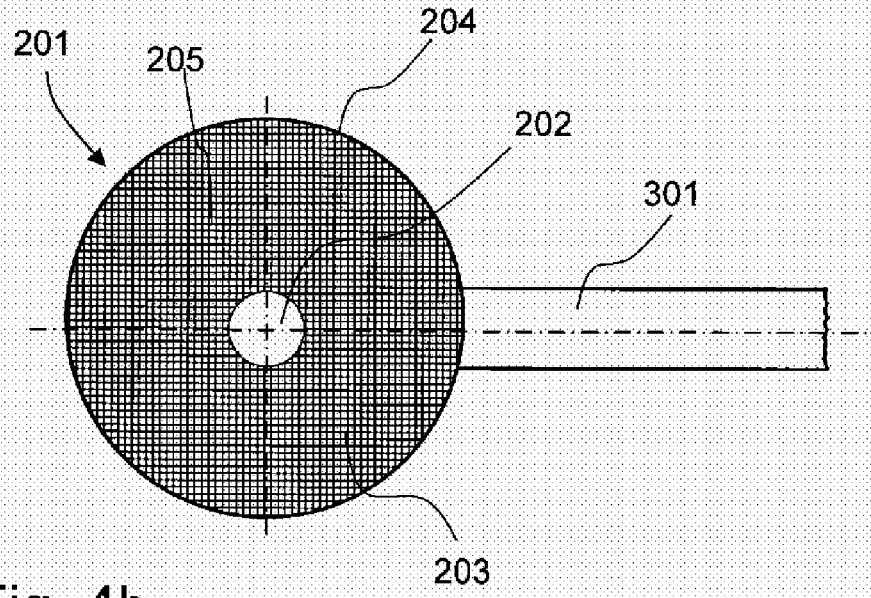

FIGS. 4*a* and 4*b* show a third preferred embodiment of the bucket-shaped outlet 201 where the outlet has a bottom surface 203. Parts of or, preferably, the complete bottom surface 203 are perforated with strainer holes or slits 205. From the perforated bottom surface 203 a fraction Q2 of the fluid in the chips suspension is withdrawn by a pump 303 through a withdrawal space 206. The shaft 106 (not shown in this drawing) passes through a penetrating opening 202 in the bucket-shaped outlet 201.

Figure 5A:
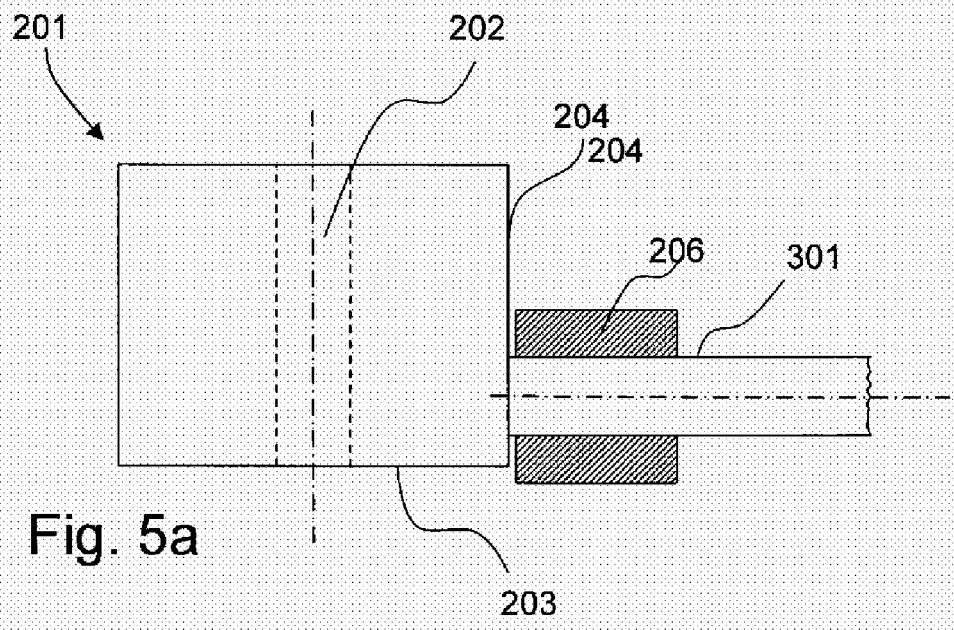
FIG. 5*a* shows a side view with a section C-C and FIG. 5*b* shows a top view of a fourth preferred embodiment of the bucket-shaped outlet 201 and outlet line 301.
Figure 5B:
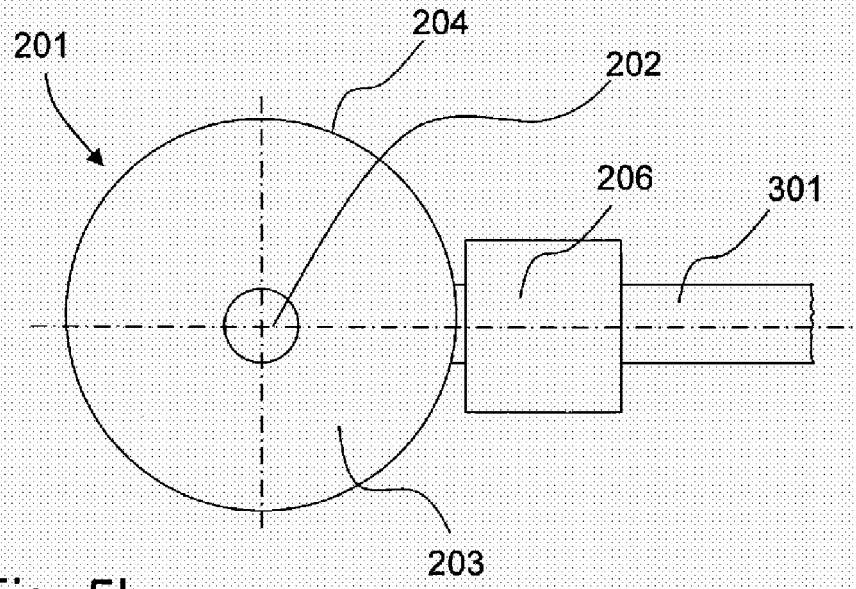

FIGS. 5*a* and 5*b* show a fourth preferred embodiment where the surface of the outlet line 302 is partially or fully perforated strainer holes or slits 205. From the perforated surface a fraction Q2 of the fluid in the chips suspension is withdrawn by a pump 303 through a withdrawal space 206 arranged around the perforated strainer holes or slits 205 in the outer surface of the outlet line.

Figure 6A:
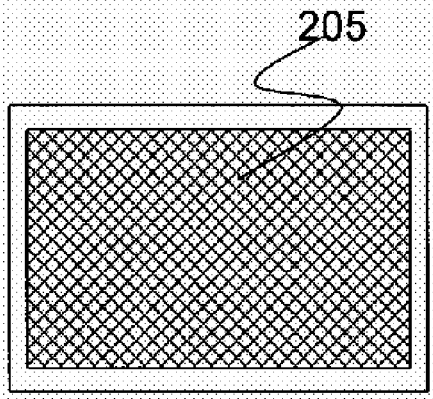
FIGS. 6*a*, 6*b* and 6*c* show different embodiments of the appearance of different strainer surfaces of the bucket-shaped outlet.

FIG. 6*a* shows a fifth preferred embodiment of how the strainer surface of the bucket-shaped outlet, which consists of strainer holes or slits 205, may appear. The complete surface is perforated in this case.

Figure 6B:
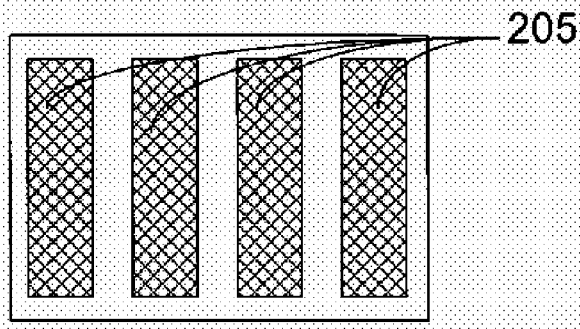

FIG. 6*b* shows a sixth preferred embodiment in which parts of the strainer surface are perforated by strainer holes or slits 205.

Figure 6C:
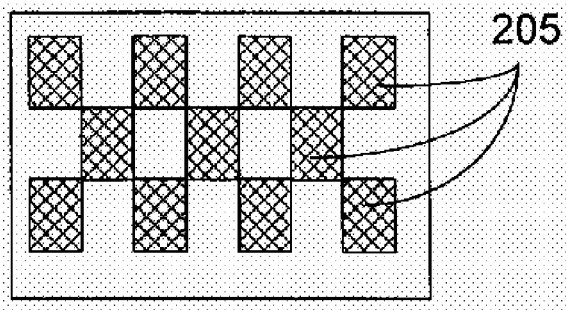

FIG. 6*c* shows a seventh preferred embodiment in which parts of the strainer surface are perforated with strainer holes or slits 205.

Figure 7A:
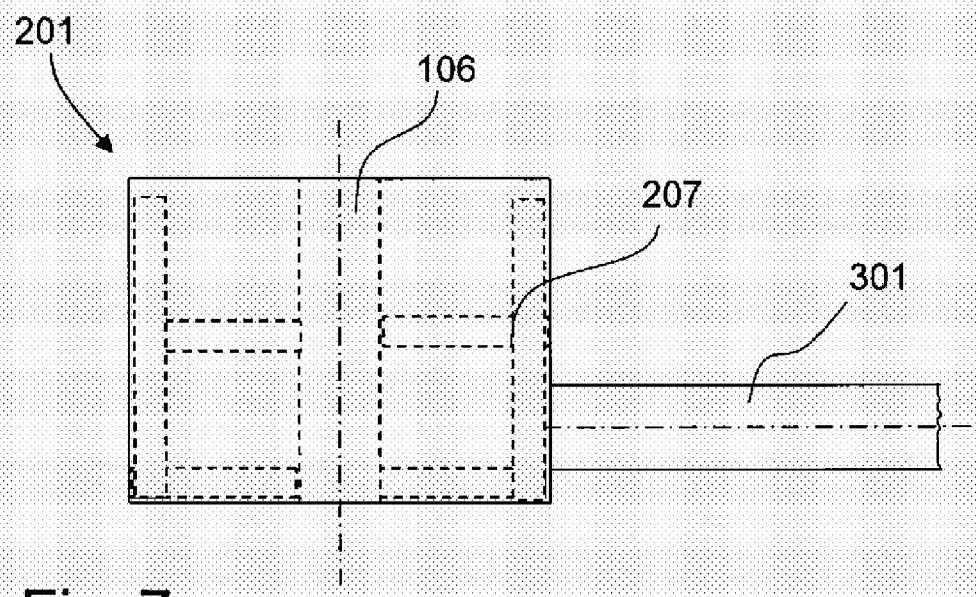
FIG. 7 shows an embodiment of how scraper arms 207 are arranged around shaft 106 in order to maintain the holes or slits in the strainer clean.
Figure 7B:
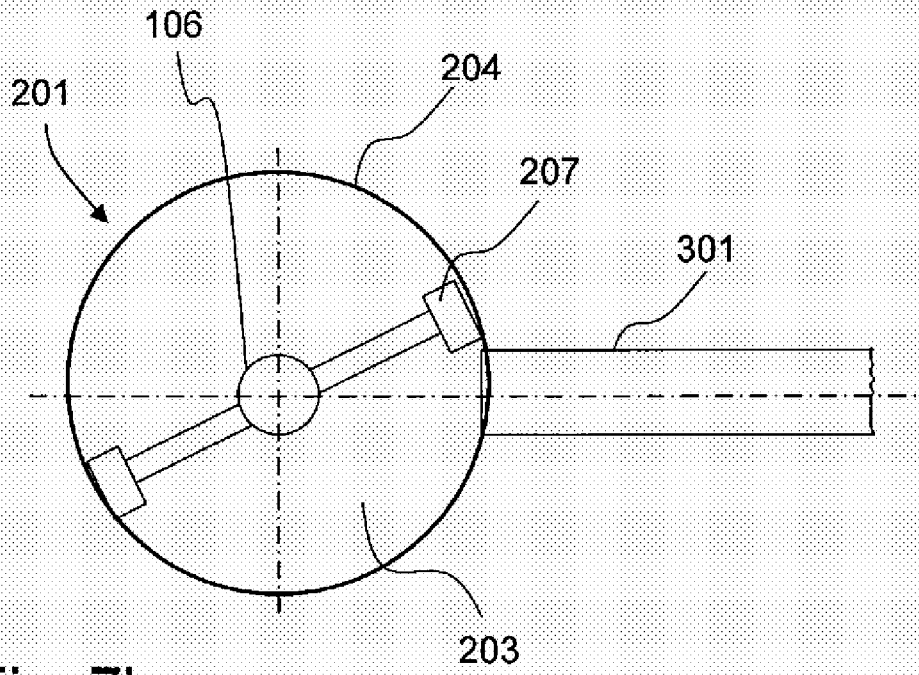

FIGS. 7*a* and 7*b* shows a side view and a top view of the bucket-shaped outlet 201 where scraper arms 207 have been arranged on a shaft 106 with the aim of maintaining the strainer holes or slits in the strainer surfaces of the bucket-shaped outlet clean, such that they do not become clogged.

Figure 8A:
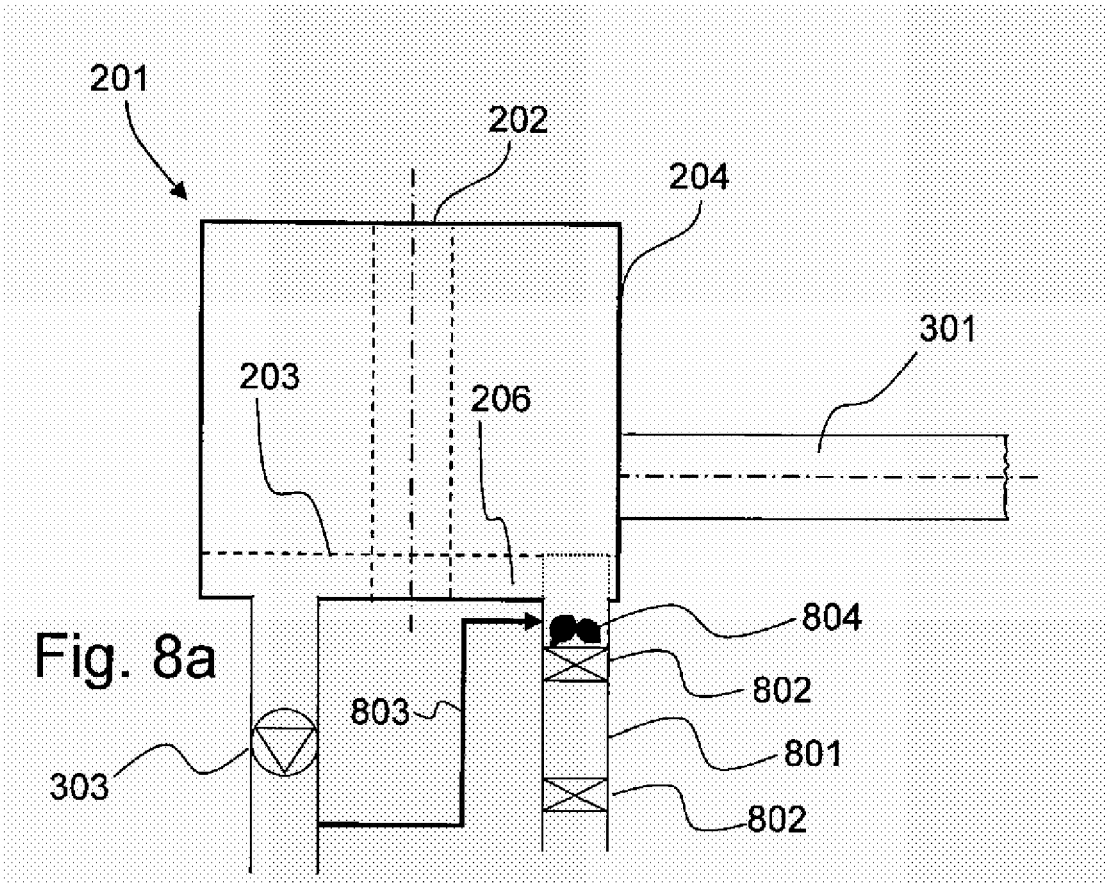
FIG. 8 shows an embodiment of a variant of the embodiment in FIG. 4, in which a debris trap is arranged under the bottom surface.
Figure 8B:
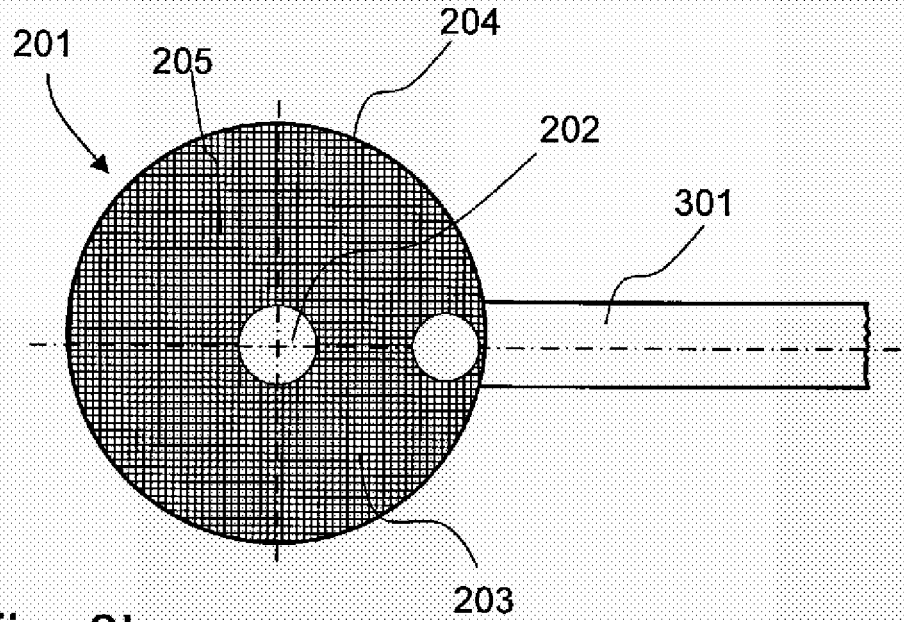

FIGS. 8*a* and 8*b* show an eighth preferred embodiment of the bucket-shaped outlet 201 where the outlet has a bottom surface 203, similar to that shown in FIGS. 4*a* and 4*b*. Parts of, preferably the complete, bottom surface 203 are perforated with strainer holes or slits 205. From the perforated bottom surface a fraction Q2 of fluid is withdrawn from the chips suspension with the pump 303 through the withdrawal space 206. An outlet 801 is present in the bottom surface 203 with a space arranged under the bottom surface. Sluice valves 802 are arranged in the space of the outlet, which valves can be emptied of coarse material 804 that collects in this space during operation. It is an advantage if the outlet is arranged in the vicinity of the outlet line 301, since the chips suspension passes the outlet, such that the heavy or coarse material falls down into the outlet 801. It is an advantage if a fluid line 803 is arranged after the pump 303 at the space in the outlet 803. In this way, output from the outlet 803 is facilitated, in that a dilution is achieved. The scraper arms 207, which are shown in FIG. 7, aid in transporting the material 804 to the outlet 801.

The following advantages, among others, are achieved with the invention, compared with conventional technology described above as the prior art:

A reduced flow of fluid to the top separator of the digester from the pre-ceding impregnation vessel, which results in the ability to use a smaller and cheaper top separator. It is possible with a optimal embodiment to dispense completely with the top separator on the digester.

a reduced fluid content of the chips suspension that leaves the impregnation vessel, which results in the ability to use smaller, cheaper and less energy-consuming pumps or high-pressure taps, or both.

The invention is not limited to the embodiments described: several variants are possible within the scope of the attached patent claims. All of the following combinations, for example, are possible, individually or in combination:

1) strainer holes or slits 205 at a location on the outer surface 204 of the bucket-shaped outlet
2) strainer holes or slits 205 at a location on the bottom surface 203 of the bucket-shaped outlet
3) strainer holes or slits 205 in the outer surface 301 of the line.

While the present invention has been described in accordance with preferred compositions and embodiments, it is to be understood that certain substitutions and alterations may be made thereto without departing from the spirit and scope of the following claims.

The invention claimed is:

1. An arrangement for the feed of a chips suspension from a vessel to a subsequent digester in a continuous cooking process for the production of chemical cellulose pulp, comprising:

a vessel arranged essentially vertically, the vessel having an inlet defined therein for a feed in of chips and having an outlet defined therein for a feed out of chips;

an outlet line connected to the outlet, in order to transport a chips suspension to a subsequent digester by means of placing the chips suspension under pressure with a pressure device in operative engagement with the outlet line, the vessel having a diameter D1, the outlet having a diameter D2 and the outlet line having a diameter D3, and the diameter D1 being greater than the diameter D2 and the diameter D2 being greater than the diameter D3; and at least a part of the outlet before the pressure device being perforated with strainer holes or slits; and a fraction of fluid in the chips suspension being adapted to be withdrawn from the strainer holes or slits in the outlet before a remaining chips suspension is being placed under pressure by means of the pressure device and sent to the subsequent digester in operative engagement with the outlet line.

2. The arrangement according to claim 1, wherein a stirrer is arranged at a bottom of the vessel for stirring the chips suspension.

3. The arrangement according to claim 1 wherein a withdrawal space is arranged on an outside of the outlet, and where the fraction of the fluid is withdrawn from the strainer holes or slits through the withdrawal space by means of a pump in operative engagement therewith.

4. The arrangement according to claim 1 wherein at least one dilution fluid supply nozzle is arranged in a vicinity of a bottom of the vessel, which nozzle is adapted to add dilution fluid to the vessel.

5. The arrangement according to claim 1 wherein the outlet has a form of a cylindrical bucket.

6. The arrangement according to claim 1 wherein at least a part of an outer surface of a bucket-shaped outlet is perforated with strainer holes or slits, from which the perforated outer surface a fraction of fluid of the chips suspension is withdrawn.

7. The arrangement according to claim 6 wherein at least a part of the outer surface of the bucket-shaped outlet is perforated with an angle of inclusion between 90° and 270° from which perforated outer surface the fraction of fluid of the chips suspension is withdrawn.

8. The arrangement according to claim 6 wherein at least a part of a bottom surface of the bucket-shaped outlet is perforated with strainer holes or slits, from which the perforated bottom surface a fraction of fluid of the chips suspension is withdrawn.

9. The arrangement according to claim 6 wherein the outlet line connected to the of the bucket-shaped outlet is provided with perforating holes or slits on at least a part of the outer surface of the bucket-shaped outlet, from perforated holes or slits a fraction of fluid of the chips suspension is withdrawn.

10. The arrangement according to claim 6 wherein a first input end of a circulation line is connected to at least one withdrawal space arranged at the bucket-shaped outlet and where a second end of the circulation line is connected to a recovery system (REC).

11. The arrangement according to claim 6 wherein a first input end of a circulation line is connected to at least one withdrawal space arranged at the bucket-shaped outlet and where a second end of the circulation line is connected to dilution fluid supply nozzles.

12. The arrangement according to key on claim 6 wherein an outlet is arranged in the bottom surface of the bucket-shaped outlet with a space arranged under the bottom surface, which space is adapted to be emptied through sluices of coarse material that collects in the space during operation.

13. The arrangement according to claim 1 wherein a first input end of a circulation line is connected to at least one withdrawal space and where a second end of the circulation line is connected to a position (A) close to a top of the vessel.

14. The arrangement according to claim 1 wherein a first input end of a circulation line is connected to at least one withdrawal space and where a second end of the circulation line is connected to a position B in a subsequent digester.

* * * * *